United States Patent [19]

Tomisawa

[11] Patent Number: 4,854,287

[45] Date of Patent: Aug. 8, 1989

[54] APPARATUS FOR LEARNING AND CONTROLLING AIR/FUEL RATIO IN INTERNAL COMBUSTION ENGINE

[75] Inventor: Naoki Tomisawa, Isesaki, Japan

[73] Assignee: Japan Electronic Control Systems Co., Ltd., Isesaki, Japan

[21] Appl. No.: 98,038

[22] Filed: Sep. 17, 1987

[30] Foreign Application Priority Data

Oct. 21, 1986 [JP] Japan ..... 61-248315
Oct. 22, 1986 [JP] Japan ..... 61-249565

[51] Int. Cl.[4] ..... F02D 41/12; F02D 41/14
[52] U.S. Cl. ..... 123/489; 123/493
[58] Field of Search ..... 123/440, 489, 493

[56] References Cited

U.S. PATENT DOCUMENTS 4,615,319 10/1986 Tomisawa .
4,655,188 4/1987 Tomisawa et al. .
4,715,344 12/1987 Tomisawa ..... 123/489
4,726,344 2/1988 Ando et al. ..... 123/489 X
4,729,359 3/1988 Tomisawa et al. ..... 123/489 X

FOREIGN PATENT DOCUMENTS 106826 9/1976 Japan .
13130 1/1983 Japan .
27819 2/1983 Japan .
10764 1/1984 Japan .
203828 11/1984 Japan .
203829 11/1984 Japan .
211738 11/1984 Japan .
211742 11/1984 Japan .
90944 5/1985 Japan .
93143 5/1985 Japan .

*Primary Examiner*—Tony M. Argenbright
*Attorney, Agent, or Firm*—Sandler & Greenblum

[57] ABSTRACT

An apparatus for learning and controlling an air/fuel ratio in an engine wherein a fuel injection quantity Ti is computed by correcting a basic fuel injection quantity Tp by a feedback correction coefficient LAMBDA based on a detected air/fuel ratio. Deviation of LAMBDA from a reference value during the feedback control is learned to determine a learning correction coefficient, and on computation of Ti, Tp is corrected by a learning correction coefficient. A base air/fuel ratio obtained from Ti computed without correction by LAMBDA is made in agreement with an aimed air/fuel ratio and during the feedback control, Ti is computed by further correcting the air/fuel ratio by LAMBDA. The learning correction coefficient is divided into an altitude learning correction coefficient $K_{ALT}$ for learning deviation by the change of the air density with respect to all the areas of the engine driving state and an area-wise learning correction coefficient $K_{MAP}$ for learning the deviation by dispersion of a part for the respective area, and Ti is computed according to Tp, LAMBDA, $K_{ALT}$ and $K_{MAP}$. The deviation of the change of the air density is indiscriminately learned according to a deceleration proportion and $K_{ALT}$ is rewritten. Where only the deviation in the air density can be learned, the deviation in the air density is indiscriminately learned and $K_{ALT}$ is rewritten, and in the other region, the deviation by dispersion of a part is learned for the respective areas and the $K_{MAP}$ is rewritten.

10 Claims, 14 Drawing Sheets

EVERY 10ms
PROPORTIONAL · INTEGRATING CONTROL ROUTINE
S31
λ cont FLAG ?
0
1
S32
READING-IN OF OUTPUT VOLTAGE $V_{O2}$ OF $O_2$ SENSOR
S33
$V_{O2}$ : $V_{ref}$
>
<
RICH
LEAN
S34
REVERSION ?
YES
NO
S35
LAMBDA←LAMBDA+P
S36
LAMBDA←LAMBDA+I
S37
REVERSION ?
YES
NO
S38
LAMBDA←LAMBDA−P
S39
LAMBDA←LAMBDA−I
END

APPARATUS FOR LEARNING AND CONTROLLING AIR/FUEL RATIO IN INTERNAL COMBUSTION ENGINE

BACKGROUND OF THE INVENTION

1. Field of the Invention

The present invention relates to an apparatus for learning and controlling an air/fuel ration in an automobile internal combustion engine having an electronically controlled fuel injection apparatus with an air/fuel ratio feedback control function. More specifically, the present invention relates to an apparatus for controlling and learning the air/fuel ratio and then cope with the change of the air density which is due to the altitude.

2. Description of the Related Art

An apparatus for learning and controlling the air/fuel ratio, as disclosed in the specification of U.S. Pat. No. 4,615,319, is adopted in an automobile internal combustion engine having an electronically controlled fuel injection apparatus with an air/fuel ratio feedback control function.

In the control system where a basic fuel injection quantity calculated from a parameter of an engine driving state, which participates in the quantity of air sucked in an engine, is corrected by a feedback correction coefficient set by a proportional-integrating control based on a signal from an air/fuel ratio sensor, such as an $O_2$ sensor, disposed in the exhaust system of the engine to compute a fuel injection quantity and the air/fuel ratio is feedback-controlled to an aimed air/fuel ratio. According to the above-mentioned conventional technique, the deviation of the feedback correction coefficient from the reference value during the feedback control of the air/fuel ratio is learned for the respective predetermined areas of the engine driving state to determine a learning correction coefficient. In computing the fuel injection quantity, the basic fuel injection quantity is corrected by the learning correction coefficient for each area so that the basic air/fuel ratio obtained by the fuel injection quantity computed without correction by the feedback correction coefficient comes into agreement with the aimed air/fuel ratio, and during the feedback control of the air/fuel ratio, this is further corrected by the feedback correction coefficient to compute the fuel injection quantity.

According to this conventional technique, during the feedback control of the air/fuel ratio, follow-up delay of the feedback control can be prevented at the transient driving, and the desired air/fuel ratio can be precisely obtained at the stoppage of the feedback control of the air/fuel ratio.

Furthermore, a system where the basic fuel injection quantity Tp is determined from the throttle valve opening degree $\alpha$ and the engine rotation number N, for example. The sucked air flow quantity Q is determined from $\alpha$ and N by referring to a map and Tp is computed according to the formula of $Tp=K\cdot Q/N$(K is a constant). Another system is known where the sucked air flow quantity Q is detected by an air flow meter and the basic fuel injection quantity is computed from the flow quantity Q and the engine rotation number N according to the formula of $Tp=K\cdot Q/N$. In the case where a flap type air flow meter (volume flow rate-detecting type) is used as the air flow meter, the change of the density of air is not reflected on the computation of the basic fuel injection quantity, but if the above-mentioned learning control is performed, the computation can cope with the change of the density of air due to the altitude or the temperature of sucked air, so far as learning is advanced in a good condition.

However, in the case where an automobile descend to a lower from a higher land (e.g., a mountain) where the conventional area-wise learning had been advanced, the following problems will occur.

In a deceleration driving of the engine as a transient driving state which often occurs while an automobile is descending, the air-fuel ratio feedback control to supply fuel to the engine is frequently stopped in the deceleration driving state and the fuel supply per se, in general is interrupted under some drifting conditions since the deceleration ability deteriorates due to a response-delay in the air/fuel ratio feedback control and also from the view point of the fuel consumption efficiency. In this situation, accordingly, the air-wise learning control is not carried out at all. Further, since the temperature of the exhaust gas of the engine is low in deceleration driving which is a low-load driving, the $O_2$ sensor frequently becomes inactive, and the air/fuel ratio feedback control is generally stopped because of the deterioration of is reliability. This also results in the stoppage of the area-wise learning control.

Therefore, even if an acceleration pedal is pressed by chance and the driving enters the other driving region where the area-wise learning control is possible, it is transferred to the deceleration driving before the $O_2$ sensor becomes active, and the area-wise learning control is also stopped.

Further, even when there are chances to carry out the air-fuel ratio feedback control and the area-wise learning controls in some areas, the number of learning such possible areas is restricted and in the majority of remaining areas, the area-wise learning controls is scarcely advanced.

This description teaches that area-wise learning control is actually rarely performed in descending conditions in a meaningful manner.

As a result, when the injection fuel quantity is computed in the automobile descending based on the area-wise learning correction coefficient which had been learned in the higher altitude, the large deviation of the base air-fuel ratio toward the lean side is produced since the learned area-wise learning correct coefficient cannot respond to the change of the air density which increases with the decrease of the altitude. Appearance of the large deviation of the base air-fuel ratio results in occurrence of troubles such as reduction of the driveability and even stalling of the engine.

When the air-fuel ratio feedback control is restarted immediately after the automobile finishes descending and runs in the lower altitude, since the basic fuel injection quantity is computed based on the area-wise learning correction coefficient which had been learned in the higher altitude, the large deviation of the base air-fuel ratio from the aimed air-fuel ratio toward the lean side due to the control delay results in the same disadvantages as described above.

On the other hand, in the case where the automobile ascends to a higher altitude from a lower altitude, since the ascending driving is a kind of the transient driving, the area for learning is not fixed and even if learning is possible, learning-possible areas are limited while learning is hardly advanced in the majority of areas. Accordingly, in case of the ordinary driving or re-starting of the engine on a flat ground in the vicinity of the summit of the mountain, because of the control delay in the air/fuel ratio feedback control, an over-rich state in the air-fuel mixture gas is produced. This over-rich state is also produced because of the large deviation of the basic air/fuel ratio from the aimed air/fuel ratio at the stoppage of the air/fuel ratio feedback control. Appearance of this over-rich state results in occurrence of troubles such as reduction of the drivability, stalling of the engine and worsening of the re-starting property.

The reason is as follows. Although it is necessary to learn and correct the change of the density of air from the deviation of the feedback correction coefficient from the reference value during the air/fuel ratio feedback control, since the learned deviation includes the deviation of the basic air/fuel ratio which depends on dispersion of parts such as a fuel injecting valve or a throttle body and this deviation cannot be separated from the deviation due to the change of the air density, the deviation corresponding to the change of the air density, which can be inherently indiscriminately learned, should be learned for respective areas of the driving state of the engine, and in the case where the automobile abruptly ascends to higher altitude, learning for the respective areas is impossible and learning is not substantially advanced.

The premise of learning is that the air/fuel ratio feedback control is carried out. However, in the conventional techniques, the air/fuel ratio feedback control is carried out only in the low-engine speed, low-load driving region (inclusive of the medium-engine speed, medium-load driving region) set as the air/fuel ratio feedback control region. (However, the air/fuel ratio feedback control is not carried out in the deceleration driving or when the temperature of the exhaust gas is low as is above set forth). The reason is that if the feedback control to the theoretical air/fuel ratio, that is, the aimed air/fuel ratio, is carried out in the high-rotation or high-load region, there is a risk of seizure of the engine or burning of the catalyst by elevation of the temperature, and therefore, in this region, the feedback correction coefficient is clamped and a rich output air/fuel ratio is separately obtained to prevent seizure of the engine.

Accordingly, when the automobile ascends a mountain, the driving is performed mainly in the high-load region and the air/fuel ratio feedback control is hardly performed, and hence, learning is not substantially carried out. This is another reason why the deviation corresponding to the change of the air density cannot be promptly learned.

SUMMARY OF THE INVENTION

It is the first object of the present invention to solve the foregoing problems of the conventional techniques and provide an apparatus for learning and controlling the air/fuel ratio in an internal combustion engine, in which the deviation corresponding to the change of the air density in descending of an automobile can be learned at a high speed and the air/fuel ratio can be learned and controlled in a good condition even while the automobile descends a down slope and runs in a lower land in an ordinary condition immediately after finishing descending.

It is the second object of the present invention to provide an apparatus for learning and controlling the air/fuel ratio in an internal combustion engine in which the deviation corresponding to the change of the air density in ascending of the automobile can be also learned and the air/fuel ratio can be learned and controlled in a good condition even while the automobile ascends to a higher altitude and runs in the higher altitudes in the ordinary condition immediately after finishing ascending in addition to the descending as described above.

It is the third object of the present invention to provide an apparatus for learning and controlling the air/fuel ratio in an internal combustion in which an engine driving state for learning the deviation corresponding to the change of the air density in the above-described automobile ascending is specified to the particular engine driving state where only the learning of the deviation corresponding to the change of the air density can be mainly learned and high accuracy for learning the deviation of the air density is achieved.

In order to attain the first object, according to the present invention, the apparatus for learning and controlling the air/fuel ratio is so constituted that an altitude learning correction coefficient for indiscriminately learning the deviation corresponding to the change of the air density mainly for the correction of the deviation due to the altitude for the respective areas of the engine driving state is set in a learning correction coefficient besides an area-wise learning correction coefficient for learning the deviation depending on dispersion of a part of the like and that thereby the deviation of the air density is learned and the altitude learning correction coefficient is renewed taking into consideration the fact that the larger the deceleration driving proportion in a predetermined time is when the automobile is descending. The larger an angle of descent is with reference to a horizontal line the larger the deviation of the change of the air density becomes.

More specifically, according to the present invention, there is provided an apparatus for learning and controlling the air/fuel ratio in an internal combustion engine, which comprises;

(A) engine driving state detecting means for detecting an engine driving state including at least a parameter of the quantity of air sucked in the engine;

(B) air/fuel ratio detecting means for detecting an exhaust component of the engine and detecting the air/fuel ratio in an air/fuel mixture sucked in the engine;

(C) basic fuel injection quantity setting means for setting the basic fuel injection quantity based on the parameter detected by the engine driving state detecting means;

(D) rewritable altitude learning correction coefficient storing means which stores therein an altitude learning correction coefficient for indiscriminately correcting the basic fuel injection quantity set by the basic fuel injection quantity setting means for all the areas of the engine driving state in compliance with an altitude where the engine is located;

(E) rewritable area-wise learning correction coefficient storing means which stores therein an area-wise learning correction coefficient for correcting the basic fuel injection quantity for the respective areas of the engine driving state;

(F) area-wise learning correction coefficient retrieving means for retrieving an area-wise learning correction coefficient of the corresponding area of the engine driving state from the area-wise learning correction coefficient storing means based on the actual engine driving state;

(G) feedback correction coefficient setting means for comparing the air/fuel ratio detected by the air/fuel ratio detecting means with an aimed air/fuel ratio while the engine is driven in a predetermined driving state and increasing or decreasing by a predetermined quantity a feedback correction coefficient for correcting said basic fuel injection quantity to bring the actual air/fuel ratio close to the aimed air/fuel ratio.

(H) fuel injection quantity computing means for computing the fuel injection quantity based on the basic fuel injection quantity set by the basic fuel injection quantity setting means, the altitude learning correction coefficient stored in the altitude learning correction coefficient storing means, the area-wise learning correction coefficient retrieved by the area-wise learning correction coefficient retrieving means and the feedback correction coefficient set by the feedback correction coefficient setting means;

(I) fuel injection means for injecting and supplying a fuel to the engine in an on-off manner according to a driving pulse signal corresponding to the fuel injection quantity computed by the fuel injection quantity computing means;

(J) deceleration driving state detecting means for detecting a deceleration driving state of the engine;

(K) deceleration proportion computing means for computing a deceleration proportion which is a proportion of a deceleration driving state period or number in a predetermined period based on the deceleration driving state detected by the deceleration driving state detecting means;

(L) altitude learning correction coefficient modifying means for modifying and rewriting the altitude learning correction coefficient stored in the altitude learning correction coefficient storing means according to the deceleration proportion computed by the deceleration proportion computing means; and (M) area-wise learning correction coefficient modifying means for learning the deviation of the feedback correction coefficient from a reference value for the respective areas of the engine driving state and modifying and rewriting the area-wise learning correction coefficient of the area-wise learning correction coefficient storing means so as to reduce the deviation.

According to the present invention, the basic fuel injection quantity setting means sets the basic fuel injection quantity corresponding to the aimed air/fuel ratio based on the parameter of the quantity of air sucked in the engine. The area-wise learning correction coefficient retrieving means retrieves the area-wise learning correction coefficient of the area corresponding to the actual engine driving state from the area-wise learning correction coefficient storing means. The feedback correction coefficient setting means compares the actual air/fuel ratio with the aimed air/fuel ratio and increases or decreases it by a predetermined quantity and sets the feedback correction coefficient to bring the actual air/fuel ratio close to the aimed air/fuel ratio. The fuel injection quantity computing means corrects the basic fuel injection quantity by the altitude learning correction coefficient stored in the altitude learning correction coefficient storing means, by the area-wise learning correction coefficient and further by the feedback correction coefficient and computes the fuel injection quantity. The fuel injection means is actuated by a driving pulse signal corresponding to this fuel injection quantity.

The altitude learning correction coefficient modifying means modifies and rewrites the altitude learning correction coefficient stored in the altitude learning correction coefficient storing means according to the deceleration proportion computed by the deceleration proportion computing means.

In general, when the automobile descends the down slope, the deceleration proportion is larger than that in the other engine driving state and the deceleration proportion has a tendency to be larger when the slope is steeper. This tendency fully corresponds to the changing (increasing) tendency of the air density. According to the above-described constitution of the present invention, the learning can be indiscriminately carried out in compliance with the deviation of the change of the air density in all the areas of the engine driving state by modifying the altitude learning correction coefficient according to the deceleration proportion even if the learning of the area-wise learning correction coefficient for the respective areas is not advanced. This results in the deviation of the base air/fuel ratio being restricted and the reduction of the drivability due to the shift of the air/fuel ratio to the lean side and the engine stalling being preventable.

In case of the driving on a flat land, the deceleration proportion is small and consequently the learning of the altitude learning correction coefficient is not substantially carried out. Nevertheless, by the area-wise learning correction coefficient modifying means, the deviation of the feedback correction coefficient from the reference value is learned for the respective areas of the engine driving state and the area-wise learning correction coefficient corresponding to the area of the engine driving state is modified to reduce the deviation, and the data of the area-wise learning correction coefficient storing means is rewritten. Thus, the deviation by dispersion of a part or the like is learned for the respective areas.

Incidentally, the basic fuel injection quantity setting means estimates the sucked air flow quantity, for example, from the opening degree of the throttle value and the engine rotation number and sets the basic fuel injection quantity from this sucked air flow quantity and the engine rotation number. However, a method in which the sucked air flow quantity is directly detected may be adopted. The storing areas of the area-wise learning correction coefficient storing means are sorted, for example, based on the engine rotation number and the basic fuel injection quantity, but other parameters may be used.

In order to attain the above-mentioned second and third objective to carry out a preferable altitude correction learning even in an ascending condition of the automobile, according to the present invention, the following means (N) and (O) may be disposed in addition to the above-mentioned means with respect to the altitude correction learning in a descending condition of the automobile and the following means (P) which specifies learning areas may be further disposed for interrupting learning of the area-wise learning correction coefficient in the area-wise learning correction coefficient modifying means while the altitude correction learning is performed.

(N) constant sucked-air-flow-quantity region detecting means for detecting a predetermined region of the engine where the sucked air-flow-quantity is not substantially changed according to the change of the opening degree of a throttle valve at each engine speed;

(O) second altitude learning correction coefficient modifying means for, on detection of the predetermined region by the constant sucked-air-flow-quantity region detecting means and in the predetermined driving state when the feedback correction coefficient setting means is on, learning the deviation of the feedback correction coefficient from a reference value and modifying and rewriting the altitude learning correction coefficient of the altitude learning correction coefficient storing means so as to reduce the deviation; and (P) area-wise learning correction coefficient modifying means for, on non-detecting of the predetermined region by the constant sucked-air-flow-quantity region detecting means, learning the deviation of the feedback correction coefficient from a reference value for the respective areas of the engine driving state and modifying and rewriting the area-wise learning correction coefficient of the area-wise learning correction coefficient storing mans so as to reduce the deviation.

In the case where the sucked-air-flow-quantity is not substantially changed according to the change of the opening degree of the throttle valve at each engine rotation number, the deviation of the feedback correction coefficient from the reference value is learned by the second altitude learning correction coefficient modifying means, and the altitude learning correction coefficient is modified so as to reduce this deviation and the data in the altitude learning correction coefficient storing means is rewritten. Thus, in the regions where only the deviation corresponding to the change of the air density can be learned in the ascending condition of the automobile, the deviation by the change of the air density is preferentially learned indiscriminately. Incidentally, it is not always true that in this region, any deviation by dispersion of a part or the like is not present, but since the opening degree of the throttle valve is high and the main deviation by dispersion of a part, that is, the deviation of the pulse width-injection flow quantity of the fuel injection valve or the deviation of the intake quantity characteristic by the opening degree of the throttle valve, is much smaller than in the region where the opening degree of the throttle valve is small, and this deviation can be learned while it is absorbed in the deviation by the change of the air density.

In case of the region other than the above-mentioned predetermined region, the deviation of the feedback correction coefficient from the reference value is learned for the respective areas of the engine driving state by the area-wise learning correction coefficient modifying means and the area-wise learning correction coefficient corresponding to the area of the engine driving state to reduce the deviation and rewrites the data of the area-wise learning correction coefficient storing means. Thus, the deviation by dispersion of a part or the like is learned for the respective areas.

The characteristic structural features of the present invention and the functions and effects attained by these features will become apparent from the following detailed description of embodiments.

BRIEF DESCRIPTION OF THE DRAWINGS

FIGS. 2, 2*a* and 2*b* are a function block diagram showing the fuel injection control in the control unit shown in FIG. 1.

DETAILED DESCRIPTION OF THE PREFERRED EMBODIMENTS

Figure 1:
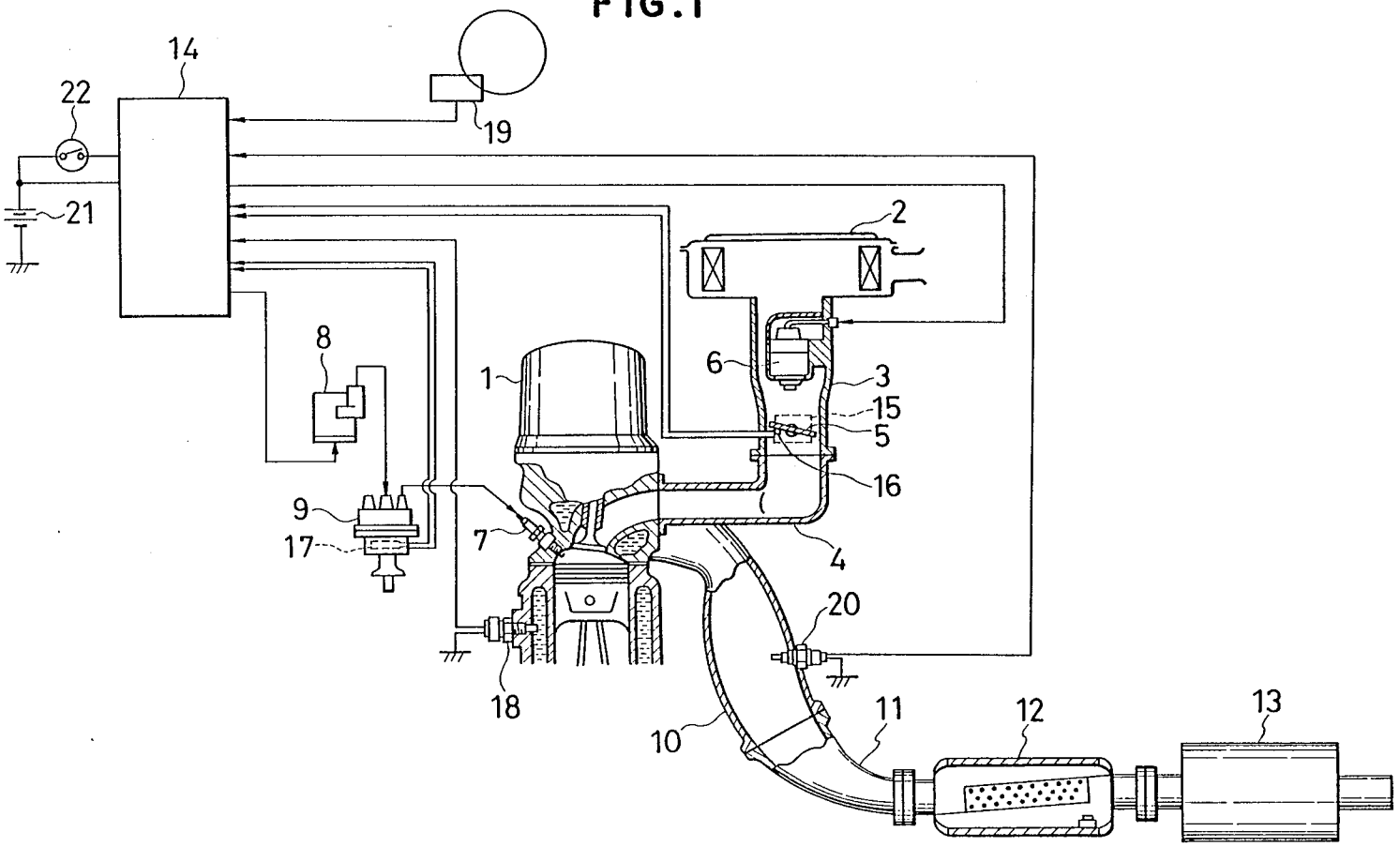
FIG. 1 is a systematic view of an internal combustion engine, which illustrates one embodiment of the present invention.

Referring to FIG. 1, air is sucked into an engine through an air cleaner 2, a throttle body 3 and an intake manifold 4.

In the throttle body 3, a throttle valve 5 interlocking with an accelerating pedal not shown in the drawings is disposed, and a fuel injection valve 6 is arranged as the fuel injecting means upstream of the throttle valve 5. The fuel injection valve 6 is an electromagnetic fuel injection valve which is opened when a solenoid is actuated and is closed when the solenoid is de-energized. Namely, the solenoid is actuated by a driving pulse signal from a control unit 14 described hereinafter to open the fuel injection valve 6, and a compressed fuel fed from a fuel pump not shown in the drawings is injected and supplied while the pressure of the fuel is adjusted to a predetermined level by a pressure regulator. In the present embodiment, a single-point injection system is adopted, but a multi-point injection system in which fuel injection valves are arranged for the respective cylinders in a branching portion of the intake manifold or in an intake port of the engine may also be used.

An ignition plug 7 is arranged in a combustion chamber of the engine 1, and a high voltage generated in a spark coil 6 based on an ignition signal from the control unit 14 is applied to the ignition plug 7 through a distributor 9 to fire and burn an air/fuel mixture by the spark ignition.

An exhaust gas is discharged from the engine 1 through an exhaust manifold 10, an exhaust duct 11, a ternary catalyst 12 and a muffler 13.

The control unit 14 comprises a micro-computer including CPU, ROM, A/D converter and input-output interface, and the control unit 14 receives input signals from various sensors and performs the computing process described hereinafter to control the operations of the fuel injection valve 6 and an ignition coil 8.

The sensors may include a potentiometer type throttle sensor 15 arranged in the throttle valve 5 to put out a voltage signal corresponding to the opening degree of the throttle valve and an idle switch 16 arranged in the throttle sensor 15, which is turned on when the throttle valve 5 is at the fully closed position.

A crank angle sensor 17 is built in the distributor 9 to put out position signals by every crank angle of 2° and reference signals by every crank angle of 180° (in case of a 4-cylinder engine). The engine rotation number N can be calculated by measuring the pulse number of position signals per unit time or the frequency of reference signals.

A water temperature sensor 18 is included for detecting the temperature Tw of engine-cooling water and a car speed sensor 19 for detects a car speed VSP.

The throttle sensor 15 and crank angle sensor 17 are detect the engine driving state.

An $O_2$ sensor 20 is arranged in the exhaust manifold 10. This $O_2$ sensor is a known sensor in which the electromotive force abruptly changes at the boundary where the air/fuel mixture is burnt in the vicinity of the theoretical air/fuel ratio which is the aimed air/fuel ratio. Accordingly, the $O_2$ sensor 20 acts as the means for detecting the air/fuel ratio i.e., whether it is (rich or lean).

A battery 21 is connected to the control unit 14 through an engine key switch 22 as a power source for the control unit 14 or as means for detecting the power source voltage. As the power source for the operation of RAM in the control unit 14, a battery 21 is connected to the control unit 14 through an appropriate stabilizing power source, not through the engine key switch 22, so that the memory content can be retained even after the engine key switch 22 is turned off.

Figure 2A:
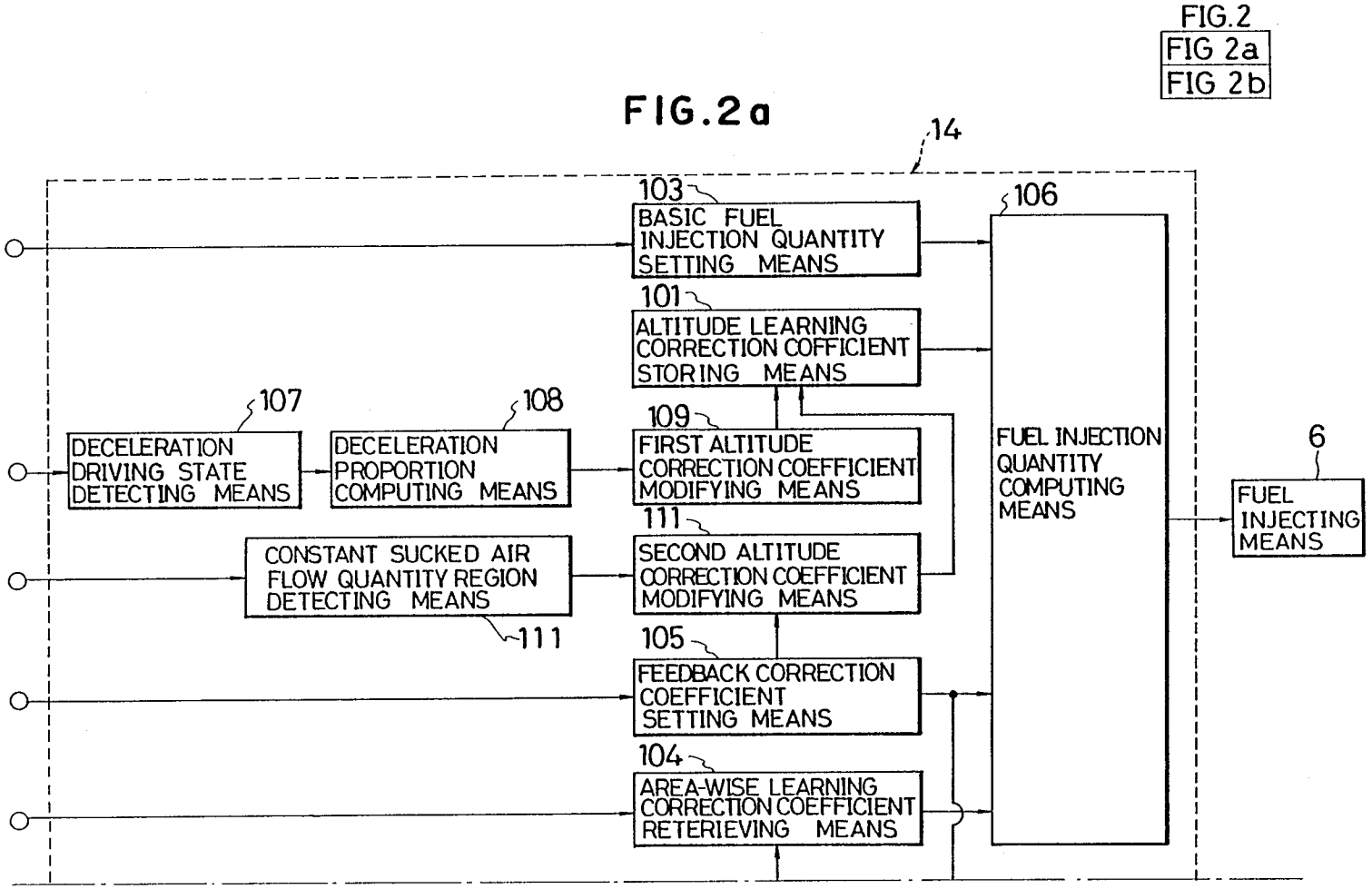
Figure 2B:
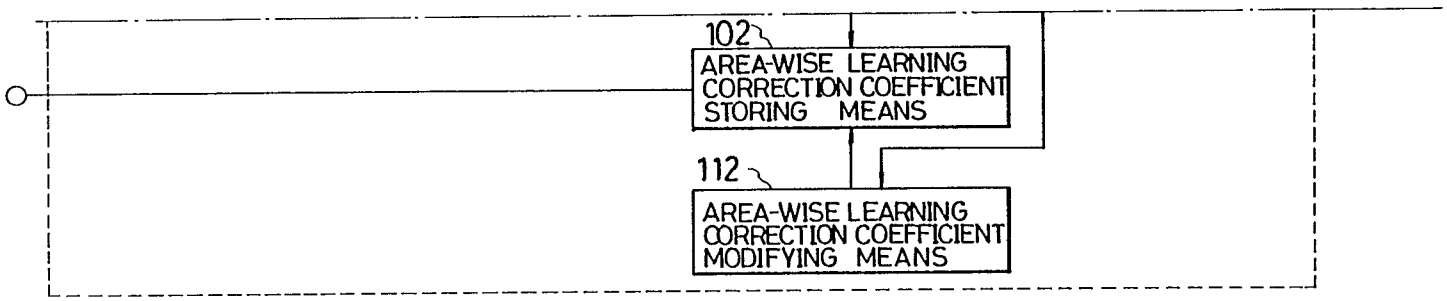

In this embodiment, the CPU built in the micro-computer 14 performs computing process according to programs (fuel injection quantity computing routine, feedback control zone judging routine, proportional-integrating control routine, learning routine, $K_{ALT}$ learning sub-routine, $K_{MAP}$ learning sub-routine and initializing routine) on ROM, as shown in the block diagram of FIG. 2, in detail in flow charts of FIGS. 3 through 9, to control the injection of the fuel.

The summary of the computing processings of the microcomputer in the control unit will now be described with reference to the block diagram of FIG. 2.

Referring to FIG. 2, by RAM of the micro-computer the control unit 14 functions as rewritable altitude learning correction coefficient storing means 101 which stores an altitude learning correction coefficient $K_{ALT}$ (the initial value is, for example, 0) which is indiscriminate over all the areas of the engine driving state and as rewritable area-wise learning correction coefficient storing means 102 which stores an area-wise learning correction coefficient $K_{MAP}$ (the initial value is, for example, 0) for the respective areas of the engine rotation number N and engine load (basic fuel injection quantity Tp) indicating the driving state of the engine.

Furthermore, since the CPU of the micro-computer of the control unit 14 performs computing according to the programs on ROM, the control unit 14 also functions as basic fuel injection quantity setting mans 103, area-wise learning correction coefficient retrieving means 104, air/fuel ratio feedback correction coefficient setting means 105, fuel injection quantity computing means 106, deceleration driving state detecting means 107, deceleration proportion computing means 108, first altitude learning correction coefficient modifying means 109, constant sucked-air-flow region detecting means 110, second altitude learning correction coefficient modifying means 111, and area-wise learning correction coefficient modifying means 112.

The basic fuel injection quantity setting means 103 sets the basic fuel injection quantity Tp corresponding to the aimed air/fuel ratio based on the opening degree $\alpha$ of the throttle valve and the engine rotation number N, which are parameters participating in the quantity of air sucked in the engine.

The area-wise learning correction coefficient retrieving means 104 retrieves the area-wise learning correction coefficient $K_{MAP}$ of the area corresponding to the actual engine driving state (N and Tp) from the area-wise learning correction coefficient storing means 102.

The feedback correction coefficient setting means 105 compares the actual air/fuel ratio with the aimed air/fuel ratio and sets the feedback correction coefficient LAMBDA (the reference value is, for example, (1) by increasing or decreasing the feedback correction coefficient LAMBDA by a predetermined proportional constant P or integrating constant I based on the proportional-integrating control so that the actual air/fuel ratio is brought close to the aimed air/fuel ratio.

The fuel injection quantity computing means 106 corrects the basic fuel injection quantity Tp by the altitude learning correction coefficient $K_{ALT}$ stored in the altitude learning correction coefficient storing means 101, by the area-wise learning correction coefficient $K_{MAP}$ and further by the learning correction coefficient LAMBPA, whereby the fuel injection quantity $Ti = Tp \cdot (LAMBDA + K_{ALT} + K_{MAP})$ is computed. The fuel injection valve 6 as the fuel injecting means is operated by a driving pulse signal corresponding to this fuel injection quantity Ti.

The deceleration driving state detecting means 107 detects a driving state where, for example, the throttle valve is fully closed, the idle switch 16 is ON and the engine number N is a predetermined value or more or when another equivalent driving condition occurs. The deceleration proportion computing means 108 computes a deceleration proportion according to the time or the frequency of deceleration driving states detected in a predetermined automobile driving time by every same predetermined time.

Figure 14:
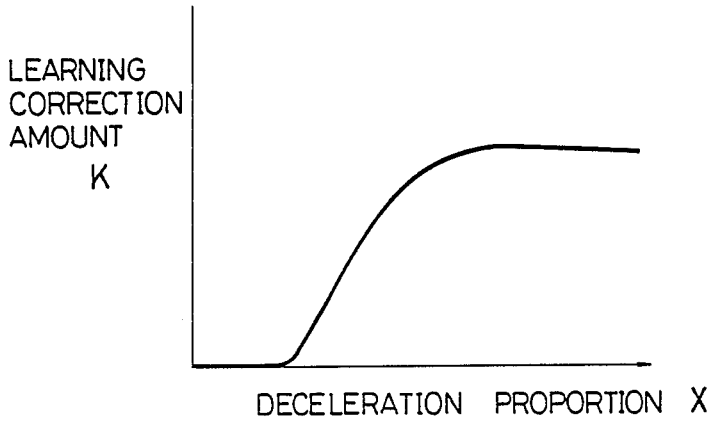
FIG. 14 is a diagram illustrating a characteristic of a learning correction amount K in the altitude learning correction coefficient in connection with a deceleration proportion X in an automobile descending.

By means of the first altitude correction coefficient modifying means, a learning correction amount K of the altitude correction coefficient, for example, as shown in FIG. 14 corresponding to the deceleration proportion is set and altitude learning correction coefficient $K_{ALT}$ is modified based on the learning correction amount K and the data of the altitude learning correction coefficient storing means 101 is rewritten.

Figure 12:
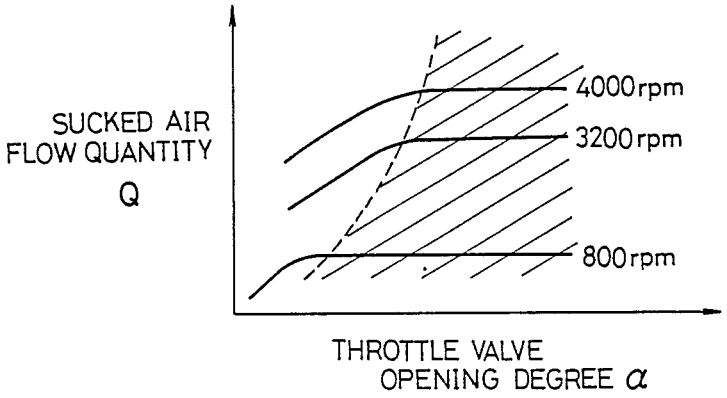
FIG. 12 is a diagram illustrating a region where learning of the altitude learning correction coefficient is carried out in the automobile ascending, that is, where the sucked-air-flow quantity becomes substantially constant according to an opening degree $\alpha$ of a throttle valve and an engine rotation number N.
Figure 13:
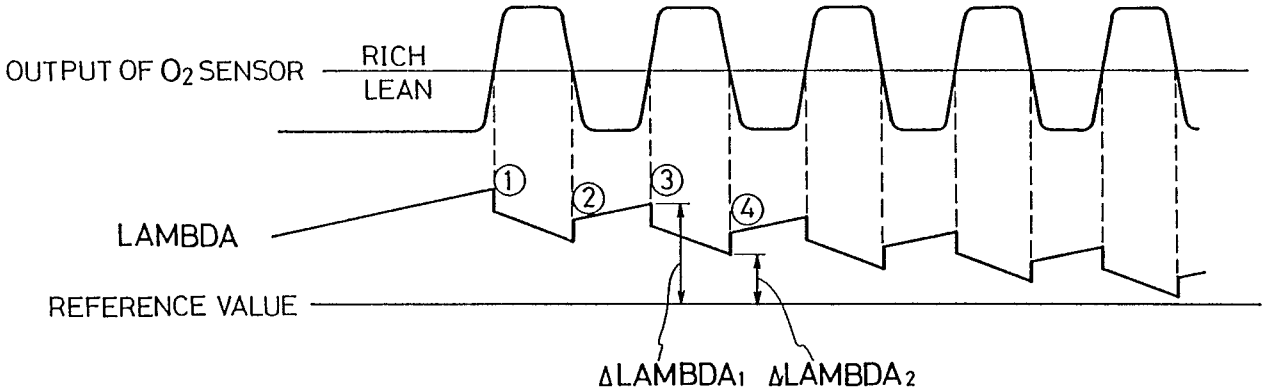
FIG. 13 is a diagram illustrating a phase of a change of an air/fuel ratio feedback correction coefficient.

The constant sucked-air-flow-quantity-region detecting means 110 detects whether or not the region is the predetermined high-load region (hereinafter referred to as "Q flat region"), where the sucked air flow quantity Q is hardly changed by the change of the throttle valve opening degree, which region is hatched in FIG. 12.

In case of the Q flat region, while the air/fuel ratio feedback control instructions are being put out, the deviation ΔLAMBDA of the feedback correction coefficient LAMBDA from the reference value (for example, 1) is learned by the second altitude learning correction coefficient modifying means 111, and the altitude learning correction coefficient $K_{ALT}$ is modified to reduce this deviation, whereby the data of the altitude learning correction coefficient storing means 101 is rewritten. More specifically, the altitude learning correction coefficient $K_{ALT}$ is renewed by adding a predetermined proportion of the deviation ΔLAMBDA to the present altitude learning correction coefficient $K_{ALT}$ according to the following formula:

$$K_{ALT} \leftarrow K_{ALT} + M_{ALT} \Delta LAMBDA$$

wherein $M_{ALT}$ represents the predetermined addition proportion.

In the above-mentioned manner, under conditions where only the deviation by the change of the air density can be learned, that is, in the region where no deviation of the system is caused by the change of the opening degree of the throttle valve 5, the deviation by the change of the air density is preferentially learned indiscriminately.

In the region other than the above-mentioned Q flat region, while the air/fuel ratio feedback control instruction are being put out, the deviation ΔLAMBDA of the feedback correction coefficient LAMBDA from the reference value for the respective areas of the engine rotation number N and basic fuel injection quantity Tp indicating the engine driving state is learned by the area-wise learning correction coefficient modifying means 112, and the area-wise learning correction coefficient $K_{MAP}$ of the area corresponding to the actual engine driving state is modified so that this deviation is reduced and the data of the area-wise learning correction coefficient storing means 102 is rewritten. More specifically, the area-wise learning correction coefficient $K_{MAP}$ is renewed by adding a predetermined proportion of the deviation ΔLAMBDA to the present area-wise learning correction coefficient $K_{MAP}$ according to the following formula:

$$K_{MAP} \leftarrow K_{MAP} + M_{MAP} \Delta LAMBDA$$

wherein $M_{MAP}$ represents the predetermined addition proportion.

In the above-mentioned manner, the deviation by dispersion of a part or the like is learned for the respective areas.

The computing process by the micro-computer in the control unit 14 will now be described in detail with reference to the flow charts of FIGS. 3 through 10.

Figure 3:
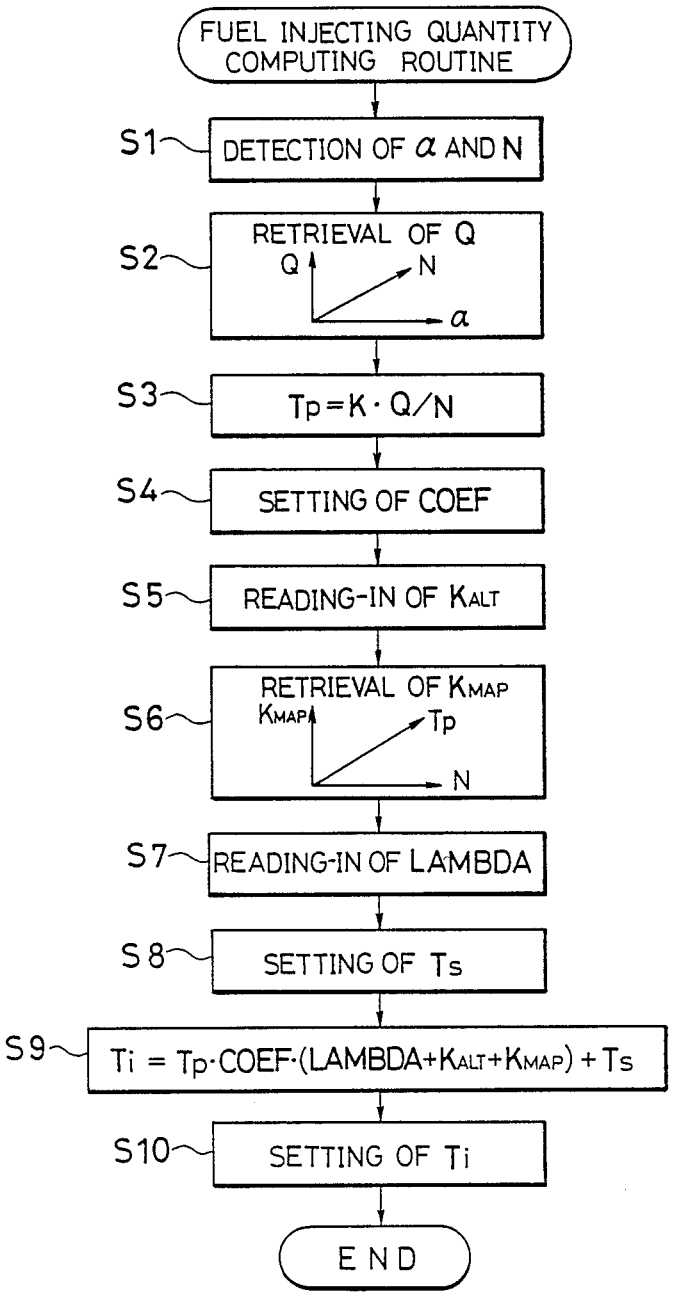
FIG. 3 is a flow chart showing the fuel injection quantity computing routine.

In the fuel injection quantity computing routine shown in FIG. 3, at step 1 (represented by S1 in the drawings; subsequent steps will be similarly represented), the throttle valve opening degree $\alpha$ detected, based on the signal from the throttle sensor 15 and the engine rotation number N calculated, based on the signal from the crank angle sensor 17, are read in.

At step 2, the sucked air flow quantity Q corresponding to the actual throttle valve opening degree $\alpha$ and engine rotation number N is retrieved and read in the micro-computer with reference to the map on ROM in which values Q corresponding to values $\alpha$ and N, which have been determined in advance by experiments or the like, are stored.

At step 3, the basic fuel injection quantity $Tp = K \cdot Q/N$ (K is a constant) corresponding to the quantity of air sucked in the engine 1 per unit rotation is computed from the sucked air flow quantity Q and the engine rotation number N. The portion of these steps 1 through 3 corresponds to the basic fuel injection quantity setting means.

Various correction coefficient COEF, including the ratio of the change of the throttle valve opening degree $\alpha$ detected, based on the signal from the throttle sensor 15, the acceleration correction coefficient by on-to-off changeover of the idle switch 16, the water temperature correction coefficient corresponding to the engine-cooling water temperature Tw detected, based on the signal from the water temperature sensor 18 and the mixture ratio correction coefficient corresponding to the engine rotation number N and basic fuel injection quantity Tp are set at step 4.

At step 5, the altitude learning correction coefficient $K_{ALT}$ stored at a predetermined address of RAM as the altitude learning correction coefficient storing means is read in. Incidentally, before initiation of learning, the altitude learning correction coefficient $K_{MAP}$ is stored as the initial value of 0, and this initial value is read in.

At step 6, by referring to the map on RAM as the area-wise learning correction coefficient storing means, in which the area-wise learning correction coefficient $K_{MAP}$ corresponding to the engine rotation number N and basic fuel injection quantity Tp indicating the engine driving state is stored, $K_{MAP}$ corresponding to actual N and Tp are retrieved and read in. The portion of this step corresponds to the area-wise correction coefficient retrieving means. In the map of the area-wise learning correction coefficient $K_{MAP}$, the engine rotation number N is plotted on the ordinate and the basic fuel injection quantity Tp is plotted on the abscissa, and the engine driving state is divided into areas by a lattice of about 8×8. The area-wise learning correction coefficient $K_{MAP}$ is stored for each area, and at the point when learning is not initiated, the initial value of 0 is stored for all the areas.

At step 7, the feedback correction coefficient LAMBDA set by the proportional-integrating control routine shown in FIG. 5, which will be described hereinafter, is read in. Incidentally, the reference value of the feedback correction coefficient LAMBDA is 1.

At step 8, the voltage correction portion Ts is set based on the voltage value of the battery 21 to correct the change of the injection flow quantity of the fuel injection valve by the variation of the battery voltage.

At step 9, the fuel injection quantity Ti is computed according to the formula of $Ti = Tp \cdot COEF \cdot (LAMBDA + K_{ALT} + K_{MAP}) + Ts$, and the portion of this step corresponds to the fuel injection quantity computing means.

At step 10, computed Ti is set at an output resistor. Thus, at a fuel injection timing synchronous with a predetermined engine rotation number (for example, every ½ rotation), a driving pulse signal having a pulse width of Ti is given to the fuel injection valve 6 to perform injection of the fuel.

Figure 4:
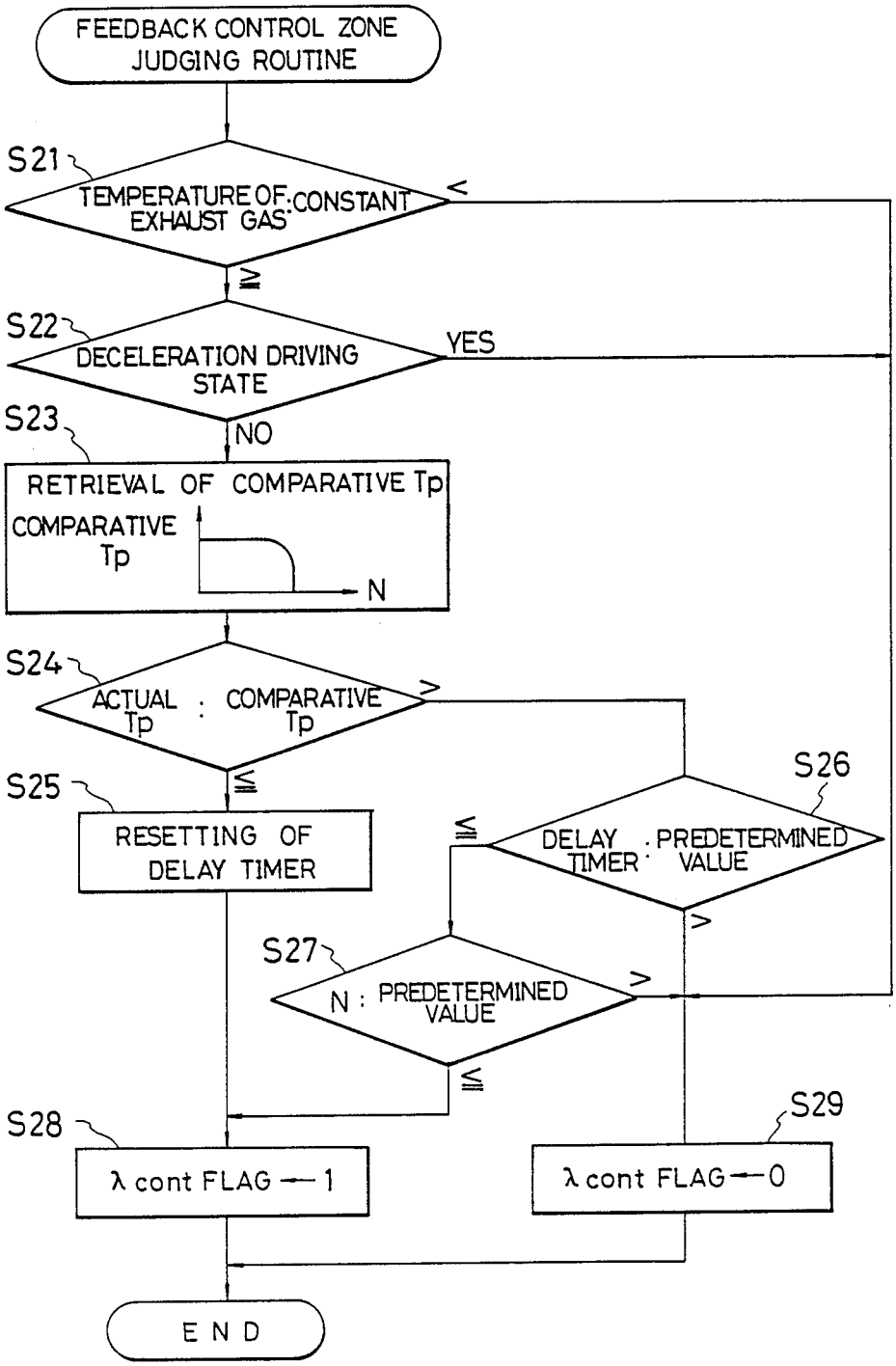
FIG. 4 is a flow chart showing the feedback control zone judging routine.
Figure 11:
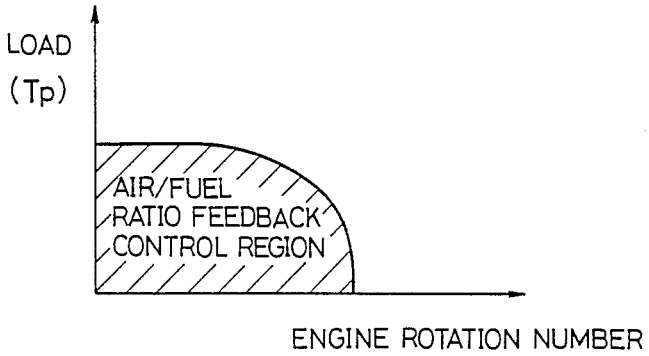
FIG. 11 is a diagram illustrating the air/fuel ratio feedback control region.

FIG. 4 shows the feedback control zone judging routine, which is disposed in principle, for performing the air/fuel feedback control in the low-rotation low-load region (hatched region in FIG. 11) and stopping the air/fuel feedback control in the high engine speed or high-load region.

At step 21, whether or not a temperature of the exhaust gas from the engine is lower than a constant, which is the upper temperature limitation of the $O_2$ sensor 20 to be inert, is judged and in case of a lower temperature than the constant based on the resulted judgement, the routine goes into a step 29 for inhibiting the air/fuel ratio feedback control because of the insufficient reliability of the control and λ controlling flag is set at 0.

At step 22, whether or not the engine is in the predetermined deceleration driving state, for example, where the throttle valve is fully closed, the idle switch 16 is ON and the engine rotation number N is a predetermined constant (for example 1,500 rpm) or more, is judged. When the judged result is yes, the routine goes into step 29 for inhibiting the air/fuel ratio feedback control to obtain sufficient deceleration ability and to enhance the fuel consumption efficiency and the λ controlling flag is set at 0. At step 23, comparative Tp is retrieved from the engine rotation number N, and at step 24, the actual fuel injection quantity Tp (actual Tp) is compared with comparative Tp.

In case of actual Tp≦comparative Tp, that is, in case of the low engine speed low-load region, the routine goes into step 25 and a delay timer (counting up by a clock signal) is reset, and the routine goes into step 28 and λ controlling flag is set at 1. This is for performing the air/fuel ratio feedback control in case of the low-rotation low engine speed region.

In case of actual Tp>comparative Tp, that is, at a high engine speed or high load, in principle, the routine goes into step 29 and λ controlling flat is set at 0. This is for stopping the air/fuel ratio feedback control and obtaining a rich output air/fuel ratio by means of another way to control the elevation of the exhaust temperature and prevent seizure of the engine 1 and burning of the catalyst ternary 12.

Incidentally, even at a high engine speed or high load, by comparing the value of the delay timer with the predetermined value at step 26, the routine goes into step 28 to keep λ controlling flag set at 1 for a predetermined time (for example, 10 seconds) after shifting to the high engine speed or high-load region, whereby the air/fuel ratio feedback control is continued for this predetermined time. This is for increasing the opportunity of learning the altitude learning correction coefficient $K_{ALT}$ because ascending is performed in the high-load region.

Incidentally, in the case where the judgement at step 25 indicates that the engine rotation number N exceeds a predetermined value (for example, 3,800 rpm) or in the case where this excess is continued for a predetermined time, the air/fuel ratio feedback control is stopped for the sake of safety.

Figure 5:
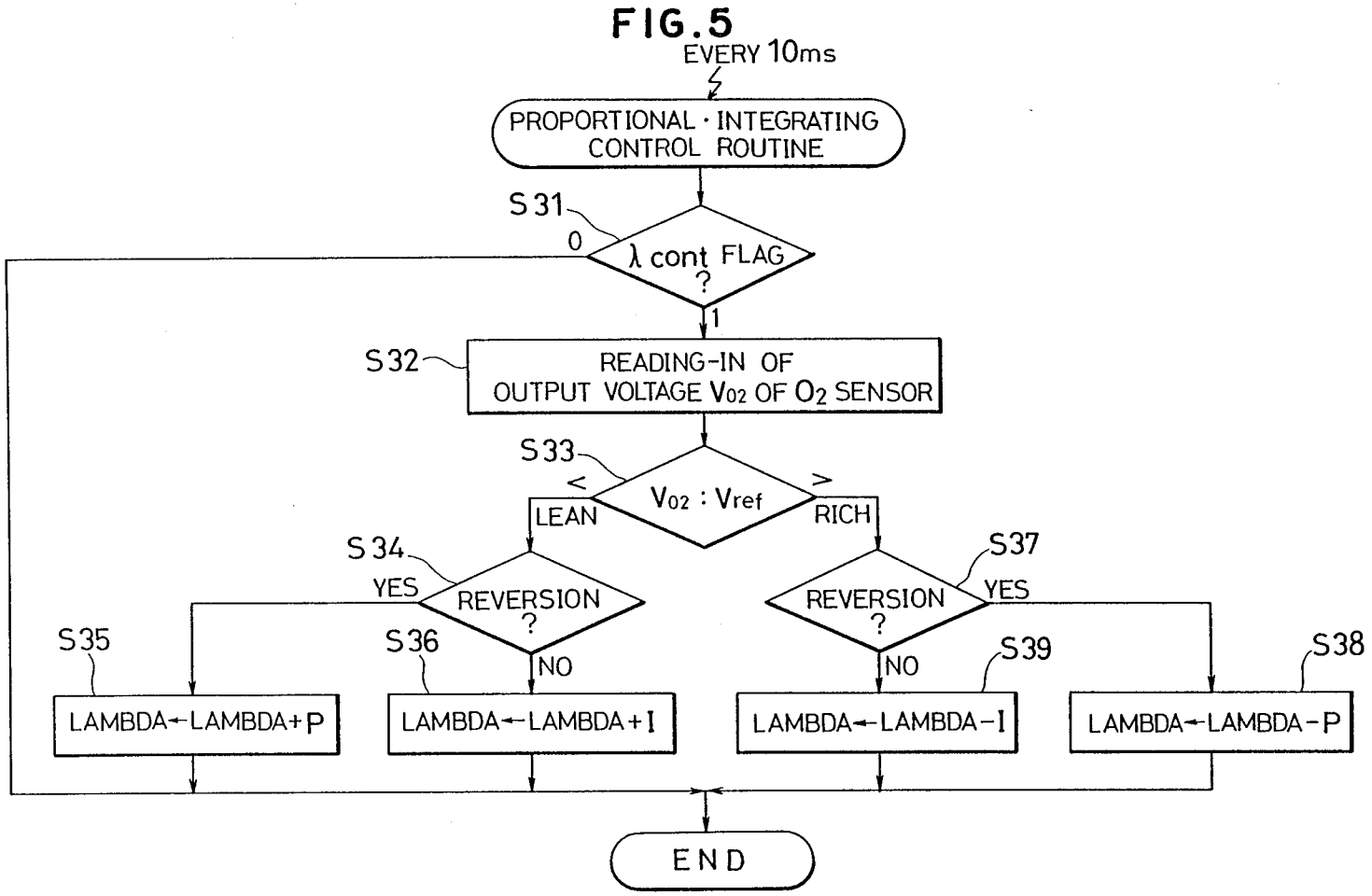
FIG. 5 is a flow chart showing the proportional-integrating control routine.

FIG. 5 shows the proportional-integrating routine, and the processing of this routine is performed at predetermined intervals (for example, 10 ms), whereby the feedback correction coefficient LAMBDA is set. Accordingly, this routine corresponds to the feedback correction coefficient setting means.

At step 31, the value of λ controlling flag is judged, and if this value is 0, this routine is ended. In this case, the feedback coefficient LAMBDA is clamped to precedent value (or the reference value of 1), and the air/fuel ratio feedback control is stopped.

In the case where the value of λ controlling flag is 1, the routine goes into step 32 and the output voltage $V_{02}$ of the $O_2$ sensor is read in, and at subsequent step 33, the output voltage $V_{02}$ is compared with the slice level voltage $V_{ref}$ corresponding to the theoretical air/fuel ratio and it is judged whether the air/fuel ratio is rich or lean.

In the case where the air/fuel ratio is lean ($V_{02}<V_{ref}$), the routine goes into step 34 from step 33, where it is judged whether or not the rich value is reversed to the lean value (just after the reversion), and when the reversion is judged, the routine goes into step 35 and the precedent value of the feedback correction coefficient LAMBDA is increased by the predetermined proportional constant P to obtain the present valve. When the case other than the reversion is judged, the routine goes into step 36, the precedent value of the feedback correction coefficient LAMBDA is increased by the predetermined integration constant I to obtain the present valve. Thus, the feedback correction coefficient LAMBDA is increased at a certain gradient. Incidentally, the relation of P and I is is.

In the case where the air/fuel ratio is rich ($V_{02}>V_{ref}$), the routine goes into step 37 from step 33 and it is judged whether the lean value is reversed to the rich value (just after the reversion), and when the reversion is judged, the routine goes into step 38 and the precedent value of the feedback correction coefficient LAMBDA is decreased by the predetermined proportional constant P. When no reversion is judged, the precedent value of the feedback correction coefficient LAMBDA is decreased by the integration constant I. Thus, the feedback correction coefficient LAMBDA is decreased at a certain gradient.

Figure 6:
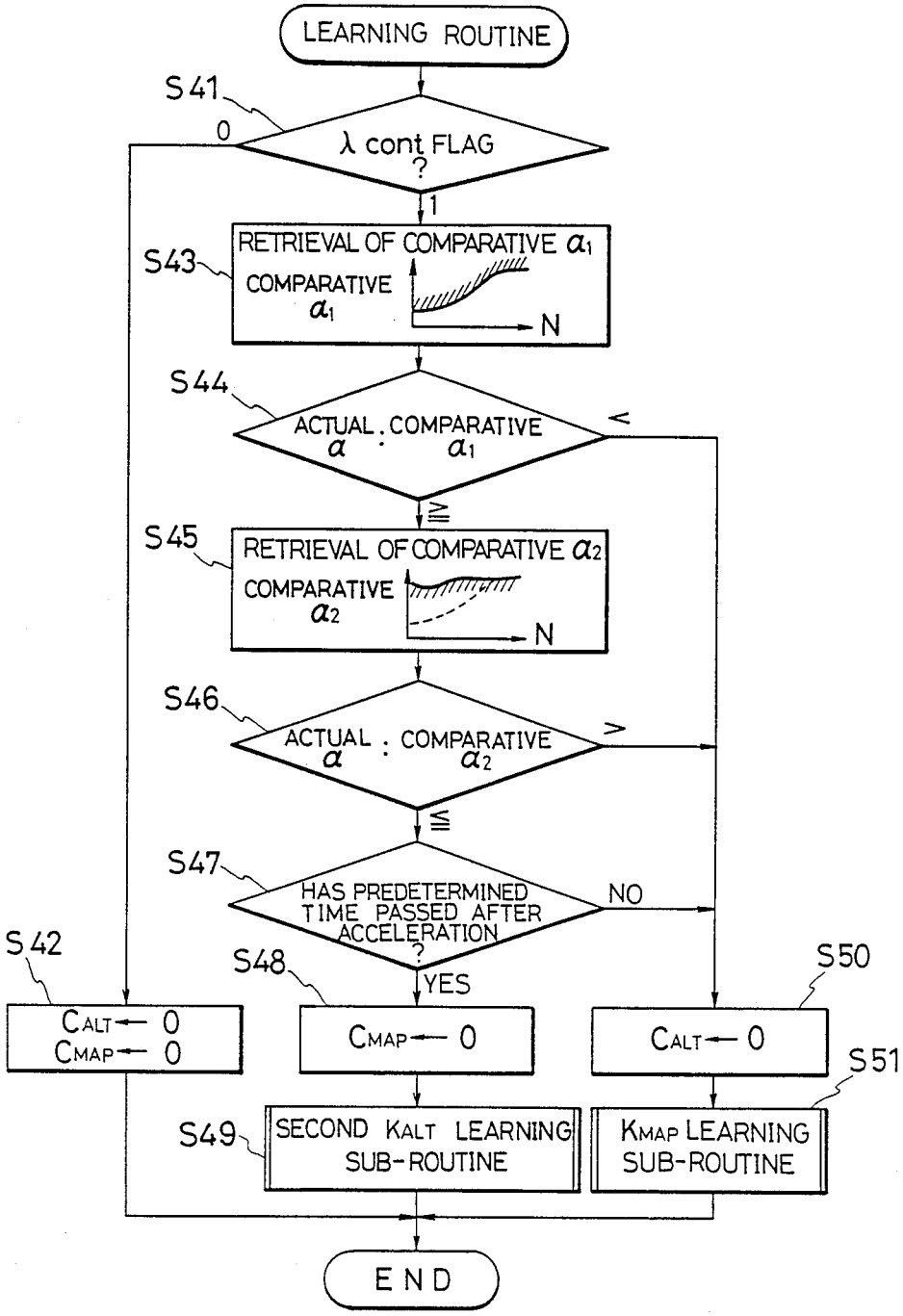
FIG. 6 is a flow chart showing the learning routine.
Figure 7:
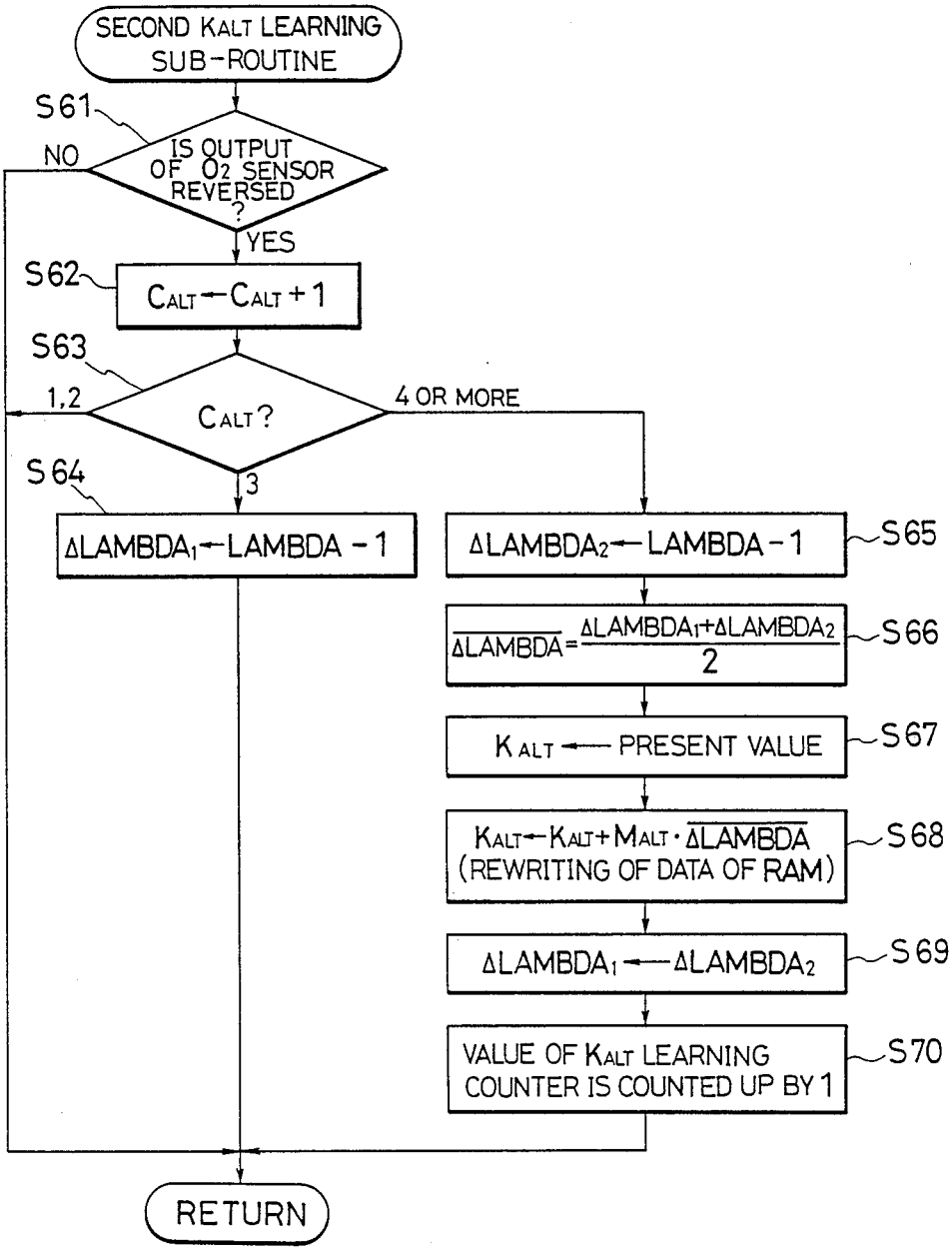
FIG. 7 is a flow chart showing the $K_{ALT}$ learning subroutine in FIG. 6.
Figure 8:
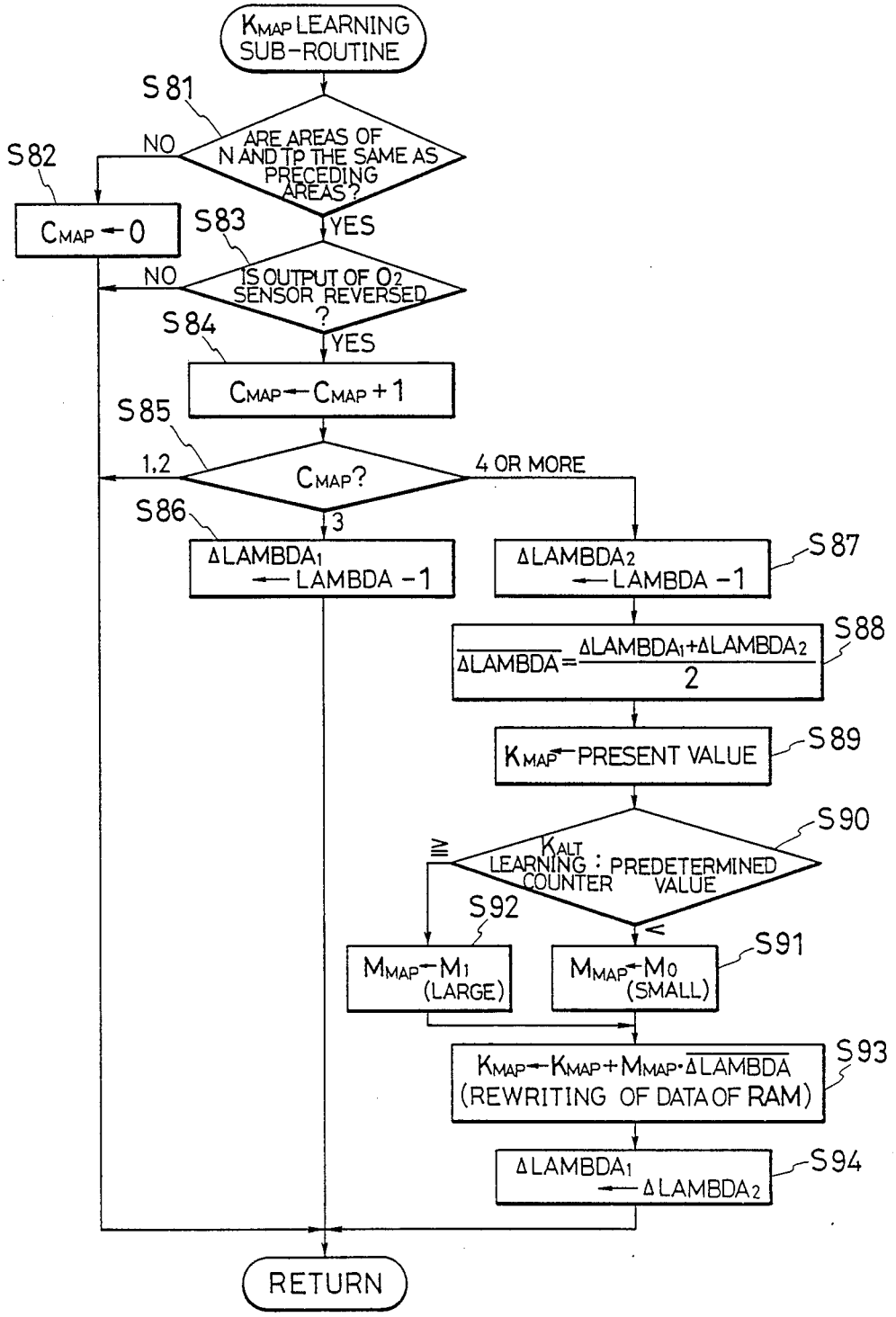
FIG. 8 is a flow chart showing the $K_{MAP}$ learning subroutine in FIG. 6.
Figure 9:
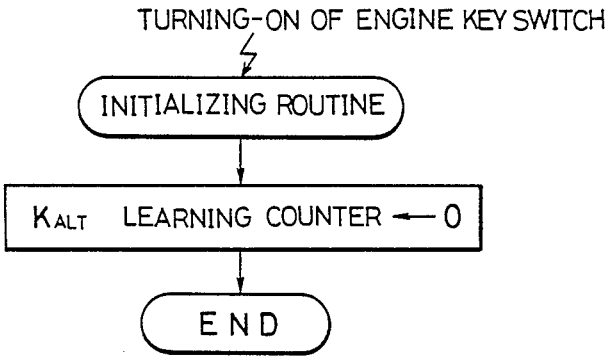
FIG. 9 is a flow chart showing the initializing routine.
Figure 10:
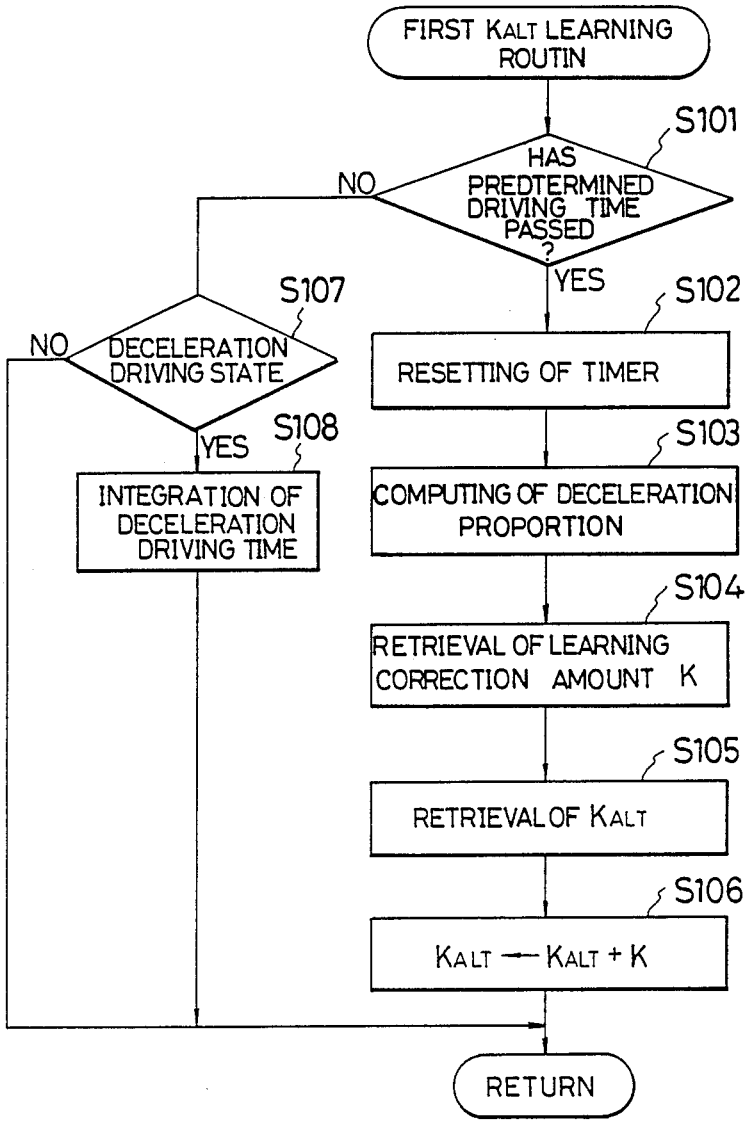
FIG. 10 is a flow chart showing the first $K_{ALT}$ learning routine.

FIG. 6 shows the learning routine, FIG. 7 shows the $K_{ALT}$ learning sub-routine, and FIG. 8 shows the $K_{MAP}$ learning subroutine and FIG. 10 shows the first $K_{ALT}$ learning routine.

At step 41 in FIG. 6, the value of λ controlling flag is judged, and when this value is 0, the routine goes into step 42 and count values $C_{ALT}$ and $C_{MAP}$ are cleared. Thus, the routine is ended. The reason is that when the air/fuel feedback control is stopped, learning cannot be performed.

In the case where the value of λ controlling flag is 1, that is, during the air/fuel ratio feedback control, the routine goes into step 43 and subsequent steps, changeover is effected between the learning of the altitude learning correction coefficient $K_{ALT}$ (hereinafter referred to as "$K_{ALT}$ learning") and the learning of the area-wise learning correction coefficient $K_{MAP}$ (hereinafter referred to as "$K_{ALT}$ learning").

More specifically, the second $K_{ALT}$ learning is preferentially performed in the Q flat region (hatched region in FIG. 11) where the sucked air quantity Q is hardly changed by the change of the throttle valve opening degree α at each engine rotation number N, and the $K_{MAP}$ learning is performed in the other region. Accordingly, at step 43, the comparative value $\alpha_1$ is retrieved from the engine rotation number N, and at step 44, the actual throttle valve opening degree α (actual α) is compared with comparative $\alpha_1$. This portion of steps 43 and 44 corresponds to the constant sucked-air-quantity region detecting means.

In case of actual α≧comparative $\alpha_1$ (Q flat region), the routine goes, in principle, into steps 48 and 49, and the count $C_{MAP}$ is cleared and the processing is carried out along the $K_{ALT}$ learning sub-routine in FIG. 7.

However, in case of the single-point injection system, in the region where the opening degree of the throttle valve 5 is very large, the flow rate of sucked air is reduced and the distribution of the fuel to the respective cylinders is worsened. Accordingly, the distribution-worsening region is allocated according to the opening degree of the throttle valve relative to the engine rotation number, and if the throttle valve opening degree exceeds this critical level, the $K_{ALT}$ learning is inhibited. Accordingly, at step 45, comparative $\alpha_2$ is retrieved from the engine rotation number N, and at step 46, actual α is compared with comparative $\alpha_2$ and in case of actual α>comparative $\alpha_2$, the routine goes into steps 50 and 51 and the count value $C_{ALT}$ is cleared. Then, the routine is changed over to the $K_{MAP}$ learning subroutine shown in FIG. 8.

In case of the single-point injection system, since the distance between the fuel injection valve 6 and the combustion chamber of the engine 1 is long and the air/fuel ratio in each cylinder is distributed by the influence of the fuel flowing on the wall during high acceleration, precise $K_{ALT}$ learning is impossible. Therefore, in the case where the engine driving state goes into the Q flat region after high acceleration, the $K_{ALT}$ learning is carried out after the lapse of a predetermined time, that is, after the water flow becomes stationary. Accordingly, at step 47, it is judged whether or not a predetermined time has passed from the point of acceleration, and when it is judged that the predetermined time has not passed, the routine goes into steps 50 and 51 and the count value $C_{ALT}$ is cleared. Then, the routine is changed over to the $K_{MAP}$ learning sub-routine shown in FIG. 8. Incidentally, the acceleration is detected based on the change ratio of the throttle valve opening degree $\alpha$ detected based on the signal from the throttle sensor 15 or based on on-to-off changeover of the idle switch 16.

In the case where actual $\alpha <$ comparative $\alpha_1$ is judged at step 44, the routine goes into steps 50 and 51, and the count value $C_{ALT}$ is cleared and the routine is changed over to the $K_{MAP}$ learning sub-routine shown in FIG. 8.

The second $K_{ALT}$ learning sub-routine shown in FIG. 7 will now be described. The second $K_{ALT}$ learning sub-routine corresponds to the second altitude learning correction coefficient modifying means.

At step 61, it is judged whether or not the output of the $O_2$ sensor 20 is reversed, that is, whether or not the increase or decrease direction of the learning correction coefficient LAMBDA is reversed. When this sub-routine is reversed repeatedly, the count value $C_{ALT}$ indicating the frequency of reversion is counted up by 1 at step 62. When $C_{ALT}$ becomes, for example, equal to 3, the routine goes into step 64 from step 63, and the deviation (LAMBDA - 1) of the present feedback correction coefficient LAMBDA from the reference value of 1 is temporarily stored as $\Delta LAMBDA_1$ and learning is initiated.

When $C_{ALT}$ becomes 4 or more, the routine goes into step 65 from step 63, and the deviation (LAMBDA - 1) of the present feedback correction coefficient LAMBDA from the reference value of 1 is temporarily stored as $\Delta LAMBDA_2$. As shown in FIG. 12, the stored $\Delta LAMBDA_1$ and $\Delta LAMBDA_2$ are upper and lower peak values of the deviation of the feedback correction coefficient LAMBDA from the reference value of 1 during the period from the preceding reversion (for example, the third reversion) to the present reversion (for example, the fourth reversion).

When the upper and lower peak values $\Delta LAMBDA_1$ and $LAMBDA_2$ of the feedback correction coefficient LAMBDA from the reference value of 1 are thus determined, the routine goes into step 66 and average value $\overline{\Delta LAMBDA}$ is determined according to the following formula:

$$\overline{\Delta LAMBDA} = (\Delta LAMBDA_1 + \Delta LAMBDA_2)/2$$

Then, the routine goes into step 67 and the present altitude learning correction coefficient $K_{ALT}$ (initial value=0) stored at a predetermined address of RAM is read out.

Then, the routine goes into step 67 and a new altitude learning correction coefficient $K_{ALT}$ is computed by adding a predetermining proportion of the average value $\overline{\Delta LAMBDA}$ of the deviation of the feedback correction coefficient from the reference value of the present altitude learning correction coefficient $K_{ALT}$, and the date of the altitude learning correction coefficient at the predetermined address of RAM is modified and rewritten as indicated by the following formula:

$$K_{ALT} \leftarrow K_{ALT} + M_{ALT}\overline{\Delta LAMBDA}$$

wherein $M_{ALT}$ stands for the addition proportion constant, which is in the range of $0 < M_{ALT} < 1$.

Then, at step 69, $\Delta LAMBDA_2$ is substituted for $\Delta LAMBDA_1$ for the subsequent learning.

Then, at step 70, the value of the $K_{ALT}$ learning counter is counted up by 1. Incidentally, the $K_{ALT}$ learning counter is set at by the initializing routine shown in FIG. 9, which is carried out when the engine key switch 22 (or the start switch) is turned on, and this counter counts the frequency of learning after turning on of the engine key switch 22.

The $K_{MAP}$ learning sub-routine shown in FIG. 8 will now be described. This $K_{MAP}$ learning sub-routine corresponds to the area-wise learning correction coefficient modifying means.

At step 81, it is judged whether or not the engine rotation number N and basic fuel injection quantity Tp, both indicating the engine driving state, are in the same area as the preceding area. In the case where the area is changed, the routine goes into step 82 and the count value $C_{MAP}$ is cleared. Thus, this sub-routine is ended.

In the case where it is judged that the area is the same as the preceding area, at step 83 it is judged whether or not the output of the $0_2$ sensor 20 is reversed, that is, whether or not the increase or decrease direction of the feedback correction coefficient LAMBDA is reversed. Every time this sub-routine is reversed repeatedly, the count value $C_{MAP}$ indicating the frequency of reversion is counted up by 1 at step 84. When the value of $C_{MAP}$ becomes equal to, for example, 3, the routine goes into step 86 from step 85, and the deviation (LAMBDA - 1) of the present feedback correction coefficient LAMBDA from the reference value of 1 is temporarily stored as $\Delta LAMBDA_1$ and learning is initiated.

When the value of $C_{MAP}$ becomes 4 or more, the routine goes into step 87 from step 85, and the deviation (LAMBDA - 1) of the present learning correction coefficient LAMBDA from the reference value of 1 is temporarily stored as $\Delta LAMBDA_2$.

When the upper and lower peak values $\Delta LAMBDA_1$ and $\Delta LAMBDA_2$ of the deviation of the learning correction coefficient LAMBDA from the reference value of 1 are thus determine, the routine goes into step 88 and the average value $\overline{\Delta LAMBDA}$ is calculated, Then, the routine goes into step 89, and the stored area-wise learning correction coefficient $K_{MAP}$ (the initial value is 0) corresponding to the present area in the map on RAM is retrieved and read out.

Then, the routine goes into step 90, the value of the $K_{ALT}$ counter is compared with the predetermined value, and when the value of the $K_{ALT}$ counter is smaller than the predetermined value, the addition proportion constant (weighting constant) $M_{MAP}$ is set at a relatively small value $M_0$ including the minimum value of 0 at step 91. On the other hand, when the value of the $K_{ALT}$ counter is equal to or larger than the predetermined value, the addition proportion constant (weighting constant) $M_{MAP}$ is set at a relatively large value $M_1$. Incidentally, the relation $M_1 << M_{ALT}$ is established.

Then, the routine goes into step 93, and a new area-wise learning correction coefficient $K_{MAP}$ is computed by adding a proportion, determined by the addition proportion constant $M_{MAP}$, of the overage value $\overline{\Delta LAMBDA}$ of the deviation of the feedback correction coefficient from the reference value to the present area-wise learning correction coefficient $K_{MAP}$ according to the following formula:

$$K_{MAP} \leftarrow K_{MAP} + M_{MAP} \cdot \overline{\Delta AMBDA}/$$

and the data of the area-wise learning correction coefficient of the same area of the map on RAM is modified and rewritten.

At step 94, $\Delta LAMBDA_2$ is substituted for $\Delta LAMBDA_1$ for the subsequent learning.

The reason why the requirement of $M_{ALT} >> M_{MAP}$ is set with respect to the addition proportion constant (weighting constant) is that the $K_{ALT}$ learning preferentially is performed by imposing a large weight on the learned value is modifying the altitude learning correction coefficient $K_{ALT}$ and imposing a small weight on the learned value in modifying the area-wise learning correction coefficient $K_{MAP}$, since the $K_{ALT}$ learning is first carried out and the area-wise $K_{MAP}$ learning is then performed.

The reason why the value of $M_{MAP}$ is changed according to the frequency of the $K_{ALT}$ learning after turning on of the engine key switch 22 (or the start switch) is that advance of the $K_{MAP}$ learning is controlled before the $K_{ALT}$ is experienced and in the extreme case, $M_{MAP}$ is set at 0 to inhibit the $K_{MAP}$ learning.

In the case where the $K_{ALT}$ learning is always made preferential to the $K_{MAP}$ learning in the above-mentioned manner, it becomes possible to prevent degradation of the driving and emission characteristics, which is caused by large gaps of the area-wise learning correction coefficient $K_{MAP}$ among the areas, which gaps are produced when the $K_{MAP}$ learning inclusive of learning of the deviation by the change of the air density is advanced only in limited areas without sufficient advance of the $K_{ALT}$ learning in the case where an automobile ascends to higher altitudes by such driving that the driving state hardly enters into the Q flat region.

The first $K_{ALT}$ learning routine shown in FIG. 10 will be described. The first altitude learning correction coefficient modifying means is included in this routine.

At step 101, it is judged whether or not the time counted by the timer has passed the predetermined driving time T and if it is yes, the routine goes into 102 and if it is no, the counted time of the timer is judged shorter than the time T and then the routine goes into step 107.

At step 102, the counted value of the timer is reset to the initial value and then counting of time is restarted.

At step 103, the deceleration proportion $X(=T_B/T \cdot 100\%)$ is computed from the integral time of the deceleration driving which is integrated in step 108 as hereinafter described with respect to the predetermined driving time T. A portion of the routine at step 101 to 103 and 108 corresponds to the deceleration proportion computing means.

At step 104, the learning correction amount K of the altitude learning correction coefficient $K_{ALT}$ corresponding to the computed deceleration proportion X is retrieved and read in referring to the map preset and stored in ROM.

The learning correction amount K is set so as to become larger when the deceleration proportion X becomes larger as shown in FIG. 14. This is because the deceleration proportion is reduced to, for example, 20%, when the automobile is driven on such a flat land as a general city road and the like, while the deceleration proportion is enlarged to, for example 60%, when the automobile is driven on a descent and further even in descending of the automobile, the deceleration proportion is increased and an altitude lowering ratio, that is, air density reducing ratio increases in the case where the angle of inclination of the descent is larger. Accordingly, in a concrete form of the present invention, the learning correction amount K is set at 0 in the vicinity of 20% of the deceleration proportion X and set to be increased in the case where the deceleration proportion X exceeds 20%.

At step 105, the altitude learning correction coefficient $K_{ALT}$ is retrieved from RAM.

At step 106, a new altitude learning correction coefficient $K_{ALT}$ is operated by adding the previously retrieved learning correction amount K to the altitude learning correction coefficient $K_{ALT}$ which has been retrieved and the data on RAM is modified and rewritten to the new altitude learning correction coefficient $K_{ALT}$. A portion of the routine at step 104 to 106 corresponds to the first altitude learning correction coefficient modifying means.

At step 107, it is judged whether or not the engine is in the deceleration driving state based on the fact that the idle switch 16 is on, that is, the throttle valve 5 is in the fully closed condition and the engine rotation number N exceeds the predetermined value (for example, 1,500 rpm) which is larger than the idle rotation number. Consequently, the functions of idle switch 16, the crank angle sensor 17 for detecting the engine rotation number N and step 107 correspond to the deceleration driving state detecting means.

The routine goes into step 108 when it is judged that the automobile is driven in the deceleration state at step 107, and the total time of the detected deceleration driving state in the predetermined driving time is integrated by the timer to obtain the deceleration integration time TB.

In this manner, the altitude learning correction coefficient $K_{ALT}$ is corrected so as to be increased according to the reduction of the air density by performing the learning control of the altitude learning correction coefficient $K_{ALT}$ corresponding to the deceleration proportion in descending of the automobile.

As a result, when the fuel injection quantity is computed based on the altitude learning correction coefficient $K_{ALT}$ and the area-wise learning correction coefficient $K_{MAP}$, the base air/fuel ratio for every area can be indiscriminately brought to the aimed air/fuel ratio according to the change of the air density even if the air density, is changed in the automobile descending state. Thus, inappropriate driving caused by the lean air/fuel ratio and occurrence of engine stalling can be prevented and the preferably engine drivability can be maintained. Good performance of the engine can also be obtained when the air/fuel feedback control is restarted just after the automobile has finished descending a downslope since the air/fuel ratio can be brought to the aimed air/fuel ratio with good response.

Incidentally, the present example shows the learning control system for learning the change of the air density with the automobile descending as well as ascending, however, the present invention includes the system for learning the change of the air density according to the deceleration proportion only when the automobile descends.

As is apparent from the foregoing illustration, according to the present invention, since the altitude learning correction coefficient for indiscriminately correcting the deviation of the change of the air density for every area is set besides the area-wise learning correction cy correcting the deviation of the change of the air density for every area is set besides the area-wise learning correction coefficient, and the air/fuel ratio can be brought to the aimed air/fuel ratio when the automobile descends from a higher altitude or moves to the lower altitude just after descending. Therefore, inappropriate driving caused by the lean air/fuel ratio and the engine stalling is not produced and good engine drivability can be obtained.

Further, since learning of the altitude learning correction coefficient is indiscriminately performed taking priority over the learning of the area-wise learning correction coefficient during the air/fuel feedback control in the Q flat region, that is, the engine high-load region, the deviation of the change of the air density can be learned at a high speed and the preferable air/fuel ratio learning control according to the deviation of the change of the air density can be achieved even when the automobile ascending. As a result, inappropriate driving ability, engine stalling and worsening of the engine restarting ability which are caused by the over-rich air/fuel ratio are prevented when the automobile is transferred to an ordinary driving state or restarted on the flat land in the vicinity of the summit of the mountain after ascending and good drivability can be maintained.

I claim:

1. An apparatus for learning and controlling an air/fuel ratio in an internal combustion engine comprising:

engine driving state detecting means for detecting an engine driving state including at least one area and at least one parameter having an impact on quantity of air sucked into said engine;

air/fuel ratio detecting means for detecting an exhaust component of said engine and thereby detecting said air/fuel ratio in an air/fuel mixture sucked in said engine;

basic fuel injection quantity setting means for setting a basic fuel injection quantity based on said parameter detected by said engine driving state detecting means;

rewritable altitude learning correction coefficient storing means which stores therein an altitude learning correction coefficient for indiscriminately correcting said basic fuel injection quantity set by said basic fuel injection quantity setting means for all of said areas of said engine driving state based on the altitude at which said engine is located;

rewritable area-wise learning correction coefficient storing means which stores therein an area-wise learning correction coefficient for correcting said basic fuel injection quantity for respective areas of said engine driving state;

area-wise learning correction coefficient retrieving means for retrieving an area-wise learning correction coefficient for a corresponding area of said engine driving state from said area-wise learning correction coefficient storing means based on actual engine driving state;

feedback correction coefficient setting means for comparing said air/fuel ratio detected by said air/fuel ratio detecting means with a desired air/fuel ratio while said engine is driven in a predetermined driving state and adjusting by a predetermined quantity a feedback correction coefficient for correcting said basic fuel injection quantity to bring actual air/fuel ratio close to said desired air/fuel ratio;

fuel injection quantity computing means for computing said fuel injection quantity based on said basic fuel injection quantity set by said basic fuel injection quantity setting means, said altitude learning correction coefficient stored in said altitude learning correction coefficient storing means, said area-wise learning correction coefficient retrieved by said area-wise learning correction coefficient retrieving means and said feedback correction coefficient set by said feedback correction coefficient setting means;

fuel injection means for injecting and supplying a fuel to said engine in an on-off manner according to a driving pulse signal corresponding to said fuel injection quantity computed by said fuel injection quantity computing means;

deceleration driving state detecting means for detecting a deceleration driving state of said engine;

deceleration proportion computing means for computing a deceleration proportion which is a proportion of a deceleration driving state period or number in a predetermined period based on said deceleration driving state detected by said deceleration driving state detecting means;

altitude learning correction coefficient modifying means for modifying and rewriting said altitude learning correction coefficient stored in said altitude learning correction coefficient storing means according to said deceleration proportion computed by said deceleration proportion computing means; and area-wise learning correction coefficient modifying means for learning deviation of the feedback correction coefficient from a reference value for said respective areas of the engine driving state and modifying and rewriting the area-wise learning correction coefficient of said area-wise learning correction coefficient storing means so as to reduce said deviation.

2. An apparatus for learning and controlling an air/fuel ratio in an internal combustion engine according to claim 1, wherein said basic fuel injection quantity setting means comprises means for computing said fuel injection quantity Tp according to the relational formula $Tp = K\,Q/N$ wherein Q designates sucked air flow quantity, N designates engine rotation number and K is a constant.

3. An apparatus for learning and controlling an air/fuel ratio in an internal combustion engine according to claim 2, wherein said engine driving state detecting means comprises means for detecting degree of openness of a throttle valve and means for detecting engine rotation number and wherein said basic fuel injection quantity setting means comprises means for estimating sucked air flow quantity from degree of openness of said throttle valve and said engine rotation number.

4. An apparatus for learning and controlling an air/fuel ratio in an internal combustion engine according to claim 1, wherein said area-wise learning correction coefficient storing means stores said area-wise learning correction coefficient for each area sorted according to engine rotation number and basic fuel injection quantity.

5. An apparatus for learning and controlling an air/fuel ratio in an internal combustion engine according to claim 1, wherein said fuel injection quantity computing means comprises means for computing said fuel injection quantity Ti according to the relational formula $Ti=Tp\ (LAMBDA+K_{ALT}+K_{MAP})$ wherein Tp designates basic fuel injection quantity, $K_{ALT}$ designates altitude learning correction coefficient, $K_{MAP}$ designates area-wise learning correction coefficient and LAMBDA designates feedback correction coefficient.

6. An apparatus for learning and controlling an air/fuel ratio in an internal combustion engine comprising:

engine driving state detecting means for detecting an engine driving state including at least one parameter having an impact on quantity of air sucked into said engine;

air/fuel ratio detecting means for detecting an exhaust component of said engine and thereby detecting air/fuel ratio in an air/fuel mixture sucked into said engine;

basic fuel injection quantity setting means for setting basic fuel injection quantity based on said parameter detected by said engine driving state detecting means;

rewritable altitude learning correction coefficient storing means which stores therein an altitude learning correction coefficient for indiscriminately correcting said basic fuel injection quantity set by said basic fuel injection quantity setting means for all the areas of said engine driving state based upon altitude at which said engine is located;

rewritable area-wise learning correction coefficient storing means which stores therein an area-wise learning correction coefficient for correcting said basic fuel injection quantity for respective areas of said engine driving state;

area-wise learning correction coefficient retrieving means for retrieving an area-wise learning correction coefficient for the corresponding area of said engine driving state from said area-wise learning correction coefficient storing means based upon actual engine driving state;

feedback correction coefficient setting means for comparing air/fuel ratio detected by said air/fuel ratio detecting means with a desired air/fuel ratio while said engine is driven in a predetermined driving state and adjusting by a predetermined quantity a feedback correction coefficient for correcting said basic fuel injection quantity to bring said actual air/fuel ratio close to said desired air/fuel ratio;

fuel injection quantity computing means for computing fuel injection quantity based on said basic fuel injection quantity set by said basic fuel injection quantity setting means, said altitude learning correction coefficient stored in said altitude learning correction coefficient storing means, said area-wise learning correction coefficient retrieved by said area-wise learning correction coefficient retrieving means and said feedback correction coefficient set by said feedback correction coefficient setting means;

fuel injection means for injecting and supplying fuel to said engine in an on-off manner according to a driving pulse signal corresponding to said fuel injection quantity computed by said fuel injection quantity computing means;

deceleration driving state detecting means for detecting a deceleration state of the engine;

deceleration proportion computing means for computing a deceleration proportion which is a proportion of a deceleration driving state period or number in a predetermined period based upon said deceleration driving state detected by said deceleration driving state detecting means;

first altitude learning correction coefficient modifying means for modifying and rewriting said altitude learning correction coefficient stored in said altitude learning correction coefficient storing means according to said deceleration proportion computed by said deceleration proportion computing means;

constant sucked-air-flow-quantity region detecting means for detecting a predetermined region of the engine where the sucked air-flow-quantity is not substantially changed notwithstanding change in the degree of openness of a throttle valve at each engine speed;

second altitude learning correction coefficient modifying means for, on detection of said predetermined region by said constant sucked-air-flow-quantity region detecting means, and in said predetermined driving state when said feedback correction coefficient setting means is on, learning deviation of said feedback correction coefficient from a reference value and modifying and rewriting said altitude learning correction coefficient of said altitude learning correction coefficient storing means so as to reduce said deviations; and area-wise learning correction coefficient modifying means for, on non-detection of said predetermined region by said constant sucked-air-flow-quantity region detecting means, learning deviation of said feedback correction coefficient from a reference value for said respective areas of said engine driving state and modifying and rewriting said area-wise learning correction coefficient of said area-wise learning correction coefficient storing means so as to reduce said deviation.

7. An apparatus for learning and controlling an air/fuel ratio in an internal combustion engine according to claim 6, wherein said constant sucked-air-flow-quantity region detecting means comprises a throttle valve degree of openness detecting means for detecting an actual throttle valve degree of openness and wherein said constant sucked-air-flow quantity region detecting means retrieves a comparative value of said throttle valve degree of openness determined according to engine rotation number, compares said comparative value and detects said constant sucked-air-flow-quantity region when said actual throttle valve opening degree is larger than said comparative value.

8. An apparatus for learning and controlling an air/fuel ratio in an internal combustion engine according to claim 6, wherein said second altitude learning correction coefficient modifying means and area-wise learning correction coefficient modifying means comprise means for renewing said altitude learning correction coefficient and area-wise learning correction coefficient, respectively, according to the renewal formulae of $$K_{ALT} \leftarrow K_{ALT} + M_{ALT} \cdot \Delta LAMBDA \text{ and}$$

$$K_{MAP} \leftarrow K_{MAP} + M_{MAP} \cdot \Delta LAMBDA$$

wherein $K_{ALT}$ designates altitude learning correction coefficient, $K_{MAP}$ designates area-wise learning correction coefficient, ΔLAMBDA designates deviation of said feedback correction coefficient from said reference value, and $M_{ALT}$ and $M_{MAP}$ designate predetermined addition proportions.

9. An apparatus for learning and controlling an air/fuel ratio in an internal combustion engine according to claim 8, wherein said relation $M_{ALT} > M_{MAP}$ is established between said addition proportion $M_{ALT}$ in said second altitude learning correction coefficient modifying means and said addition proportion $M_{MAP}$ in said area-wise learning correction coefficient modifying means.

10. An apparatus for learning and controlling an air/fuel ratio in an internal combustion engine according to claim 8, wherein said addition proportion $M_{MAP}$ in said area-wise learning correction coefficient modifying means is variable according to frequency of rewriting of said altitude learning correction coefficient by said second altitude learning correction coefficient modifying means after an engine key switch is turned on.

* * * * *

UNITED STATES PATENT AND TRADEMARK OFFICE

CERTIFICATE OF CORRECTION

PATENT NO. : 4,854,287

DATED : August 8, 1989

INVENTOR(S) : Naoki TOMISAWA

It is certified that error appears in the above-identified patent and that said Letters Patent is hereby corrected as shown below:

At column 1, line 9, change "ration" to ---ratio---.
At column 2, line 12, insert ---,--- after "general".
At column 2, line 23, change "is" to ---its---.
At column 2, line 33, change "of learning" to ---of such learning---.
At column 2, line 34, delete [such] before "possible".
At column 3, line 23, change "altitude" to ---altitudes---.
At column 4, line 9, insert ---engine---after "combustion".
At column 4, line 27, change "of the like" to ---or the like---.
At column 4, line 33, insert ---,--- after "line".
At column 7, line 16, change "mans" to ---means---.
At column 9, line 21, change "i.e., whether it is (rich" to ---(i.e., whether it is rich---.
At column 9, line 60, change "mans" to ---means---.
At column 10, line 17, change "(1)" to ---1)---.
At column 10, line 29, change "LAMBPA" to ---LAMBDA---.
At column 10, line 57, insert --- --- after "degree".
At column 11, line 64, change "coefficient" to ---coefficients---.
At column 12, line 52, insert ---,--- after "disposed".
At column 13, line 25, change "catalyst ternary" to ---ternary catalyst---.
At column 14, line 7, change "is is" to ---is P>>I---.
At column 16, line 1, change "predetermining" to ---predetermined---.
At column 16, line 17, insert ---0--- after "at".
At column 16, line 54, change "determine" to ---determined---.
At column 17, line 7, change "overage" to ---average---.
At column 17, line 12, change ". AMBDA " to ---. LAMBDA---.
At column 17, line 23, change "is" to ---in--- after "value".
At column 18, line 60, delete [,] after "density".
At column 18, line 63, change "preferably" to ---preferable---.

UNITED STATES PATENT AND TRADEMARK OFFICE

CERTIFICATE OF CORRECTION

PATENT NO. : 4,854,287

DATED : August 8, 1989

INVENTOR(S) : Naoki Tomisawa

It is certified that error appears in the above-identified patent and that said Letters Patent is hereby corrected as shown below:

At column 19, lines 13, 14 and 15, delete l[cy correcting the deviation of the change of the air density for every area is set beside the area-wise learning correction].

At column 19, line 30, change "when" to ---with---.

Signed and Sealed this

First Day of September, 1992

*Attest:*

DOUGLAS B. COMER

*Attesting Officer*

*Acting Commissioner of Patents and Trademarks*